US005392864A

United States Patent [19]

Lindenmuth

[11] Patent Number: 5,392,864

[45] Date of Patent: Feb. 28, 1995

[54] BLADE ASSEMBLY FOR A COMPACTING VEHICLE

[75] Inventor: Karl E. Lindenmuth, Wamego, Kans.

[73] Assignee: Balderson Inc., Wamego, Kans.

[21] Appl. No.: 271,387

[22] Filed: Jul. 6, 1994

Related U.S. Application Data

[63] Continuation of Ser. No. 877,495, May 1, 1992, abandoned.

[51] Int. Cl.[6] ..... E02F 3/76

[52] U.S. Cl. ..... 172/811; 172/701.1; 172/787; 37/272

[58] Field of Search ..... 37/272, 466, 274, 275, 37/273, 220, 403, 407, 903, 409, 444; 172/811, 815, 824, 825, 826, 701.1, 701.3, 784, 736, 787; 405/129

[56] References Cited

U.S. PATENT DOCUMENTS

| | | | |
|---|---|---|---|
| 2,590,352 | 3/1952 | Sanner et al. | 37/117.5 X |
| 2,757,746 | 8/1956 | Biedess | 37/117.5 |
| 3,238,648 | 3/1966 | Cobb et al. | 37/144 |
| 3,631,930 | 1/1972 | Peterson | 172/804 |
| 3,736,664 | 6/1973 | Black et al. | 37/141 R |
| 4,779,363 | 10/1988 | Boutrais et al. | 37/117.5 |
| 4,991,662 | 2/1991 | Caron et al. | 172/701.1 |

FOREIGN PATENT DOCUMENTS

| | | | |
|---|---|---|---|
| 607667 | 11/1960 | Canada | 37/117.5 |
| 2593204 | 7/1987 | France | 37/117.5 |
| 514332 | 12/1930 | Germany | 172/811 |
| 757645 | 8/1980 | U.S.S.R. | 37/117.5 |
| 891854 | 12/1981 | U.S.S.R. | 37/117.5 |

*Primary Examiner*—Dennis L. Taylor
*Assistant Examiner*—Spencer Warnick
*Attorney, Agent, or Firm*—J. W. Burrows

[57] ABSTRACT

Blade assemblies for use with compacting vehicles are normally designed to push the material in front of the blade and to control the height of the material passing thereunder for compaction by the compacting vehicle. With the blade raised to allow trash and/or soil to pass thereunder, the trash and/or soil passing thereunder may cause detrimental wear to the components under the compacting vehicle between the compacting mechanisms. In the subject arrangement, a blade assembly is provided and includes a blade pivotally connected to a frame. The blade has a working edge that permits, during use, level spreading of trash and/or soil when the blade is in a first operative position. When the blade assembly is raised and the blade is pivoted forwardly with respect to the frame, a first portion of the working edge controls the volume of trash and/or soil allowed to pass under the working edge between respective compacting mechanisms of a compacting vehicle. The remaining portion of the working edge controls the volume of trash and/or soil subjected to the respective compacting mechanisms for compaction thereof. By controlling the volume of trash permitted to pass under the first portion of the working edge, detrimental wear of the components under the compacting vehicle is substantially eliminated.

28 Claims, 6 Drawing Sheets

BLADE ASSEMBLY FOR A COMPACTING VEHICLE

This is a file wrapper continuation of application Ser. No. 07/877,495, filed May 1, 1992, now abandoned.

TECHNICAL FIELD

This invention relates generally to a blade assembly and more particularly to a blade assembly for use on a compacting vehicle.

BACKGROUND ART

Landfill compacting machines normally use a blade on the front of the vehicle to evenly spread materials being compacted so that the amount of landfill debris or trash is evenly directed under the blade for respective compacting mechanisms to demolish and/or compact. Typically in the past, the blade on the front of the landfill compacting machine is generally straight or a well known U-shape. More recently, a new style of landfill blade assembly has been introduced to the market place. This blade assembly is illustrated and described in U.S. Pat. No. 4,991,662 issued on Feb. 12, 1991 to James O. Caron et al. In this blade arrangement a central enlargement is located centrally on a typical U-blade and extends forwardly of the blade to deflect the soil and/or trash to opposite sides of the centerline of the vehicle's path so that the soil and/or trash is directed under the respective compacting wheels. During operation of the blade in the above-noted patent, it is normal practice to raise the blade above the surface the compacting wheels of the vehicle is traversing in order for soil and/or trash to pass thereunder and be subjected to the respective compacting wheels of the vehicle. Naturally, when the blade is raised to allow material to pass thereunder for compaction by the compacting wheels, there is also material passing under the center of the blade and is not being compacted by the compacting wheels. In the description of the patent noted above, it is described and subsequently claimed that the center protrusion is effective to direct trash away from the center of the blade so that the trash can be more positively directed under the blade and in line with the path of the compacting wheels of the vehicle. However, the working edge of the blade lies generally in a line transversely thereof and the blade is at a level generally equivalent to the level that the wheels are contacting the debris. Consequently, when the blade is raised to some elevated position to allow the trash to pass thereunder for compaction by the wheels, the center portion of the blade protruding forwardly thereof is naturally at a level higher than the remaining portion of the cutting edge since the entire assembly is being pivoted about the connection of the push arms with the vehicle. Therefore, it is questionable if the arrangement set forth in the above noted patent performs the described and claimed function. The problem encountered with such an arrangement and previous arrangements is that the material passing under the blade between the compacting wheels is detrimental to the unprotected components on the bottom of the vehicle. Any material passing under the center of the blade that is contacting components of the vehicle between the compacting wheels causes detrimental wear to those components and at times may become wedged under the vehicle. It is recognized that this problem possibly could be overcome by adding extra protective plates or other items under the vehicle between the compacting wheels but this adds unnecessary cost to the vehicle.

The present invention is directed to overcoming one or more of the problems as set forth above.

DISCLOSURE OF THE INVENTION

In one aspect of the present invention, a blade assembly is provided and adapted for use on a compacting vehicle having a compacting mechanism located on each side of the compacting vehicle in spaced apart relationship. The blade assembly includes a frame adapted for pivotable connection with the compacting vehicle, a blade pivotally connected to the frame, and means for pivoting, when in use, the blade relative to the frame. The blade has a working edge with a vertical plane defined therethrough transverse to the travel path of the compacting vehicle and a first portion centrally located along the blade and extending forwardly of the vertical plane. The pivoting means functions to pivot the blade relative to the frame between the first position at which the working edge is aligned generally along a plane coincidental with a surface traversed by the compacting mechanisms of the vehicle and a second position at which the first portion of the working edge is at a level, relative to the plane of the surface traversed by the compacting mechanisms, lower than the level of a remaining portion of the working edge.

In another aspect of the present invention, a landfill blade assembly is provided and is of a type serving to control the volume of trash passing under a blade of the blade assembly in the path of a compacting vehicle and into the paths of the compacting mechanisms disposed on opposite sides of the compacting vehicle. The blade assembly includes means protruding forwardly of the blade and centrally located therealong for controlling the volume of trash being directed under the blade between the compacting mechanisms. When in use, the blade assembly is raised and pivoted forwardly so that a smaller volume of trash is permitted to pass under the blade between the compacting mechanisms as compared to the volume of trash permitted to pass under the blade in the path of the compacting mechanisms.

In another aspect of the present invention, a blade assembly is provided and adapted for use on a compacting vehicle having a compacting mechanism located on each side of the compacting vehicle in spaced apart relationship and a lift cylinder mechanism operative to raise and lower the blade assembly. The blade assembly includes a frame adapted for pivotable connection with the compacting vehicle, a blade pivotally connected to the frame, and means for pivoting, when in use, the blade relative to the frame. The frame has first and second connection joints operable, when assembled, to connect the frame to the compacting vehicle and a third connection joint operable to pivotally connect the frame to the lift cylinder mechanism of the vehicle. The blade has a working edge with a vertical plane defined therethrough transverse to a travel path of the vehicle and a first portion thereof extends forwardly of the vertical plane. The pivoting means rotates the blade forwardly relative to the frame between a first position at which the first portion of the working edge and a remaining portion thereof are aligned generally along a plane coincidental with a surface traversed by the compacting mechanisms of the compacting vehicle and a second position at which the first portion is at a level, relative to the plane of the surface traversed by the compacting mechanisms of the compacting vehicle, lower than the level of the remaining portion so that upon raising the blade above the plane of the surface traversed by the compacting mechanisms of the compacting vehicle and pivoting the blade forwardly to the second position the first portion of the working edge is closer to the surface being traversed by the compacting mechanisms of the compacting vehicle than the remaining portion of the working edge.

The present invention provides a blade assembly having a centrally located mechanism that is effective in one position to spread trash and/or soil generally level with the path being traversed by the compacting vehicle and when raised and pivoted, the blade provides ample space for trash to pass thereunder for compaction by the compacting mechanisms while limiting the volume of trash passing thereunder which is not being subjected to the compacting mechanisms of the compacting vehicle. By reducing the volume of trash passing under the compacting vehicle between the compacting mechanisms, undesirable contact of the trash with the components of the bottom of the compacting vehicle between the compacting mechanisms is substantially reduced and/or eliminated.

BEST MODE FOR CARRYING OUT THE INVENTION

Figure 1:
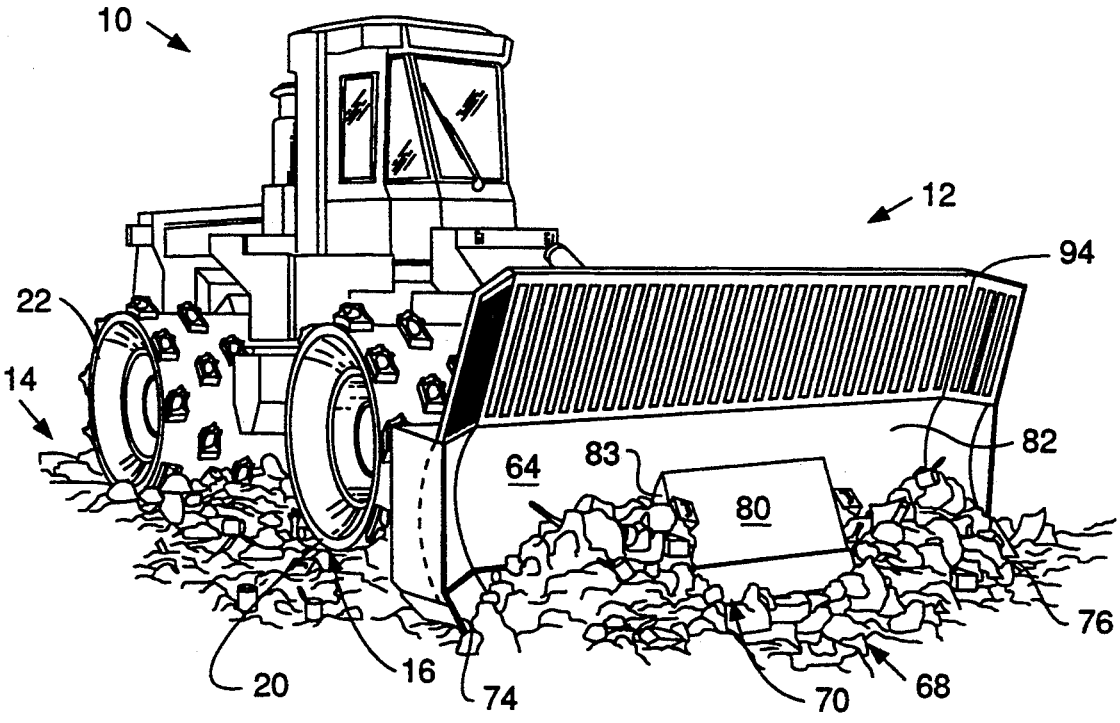
FIG. 1 is a diagrammatic representation of a compacting vehicle having a blade assembly incorporating an embodiment of the present invention.
Figure 2:
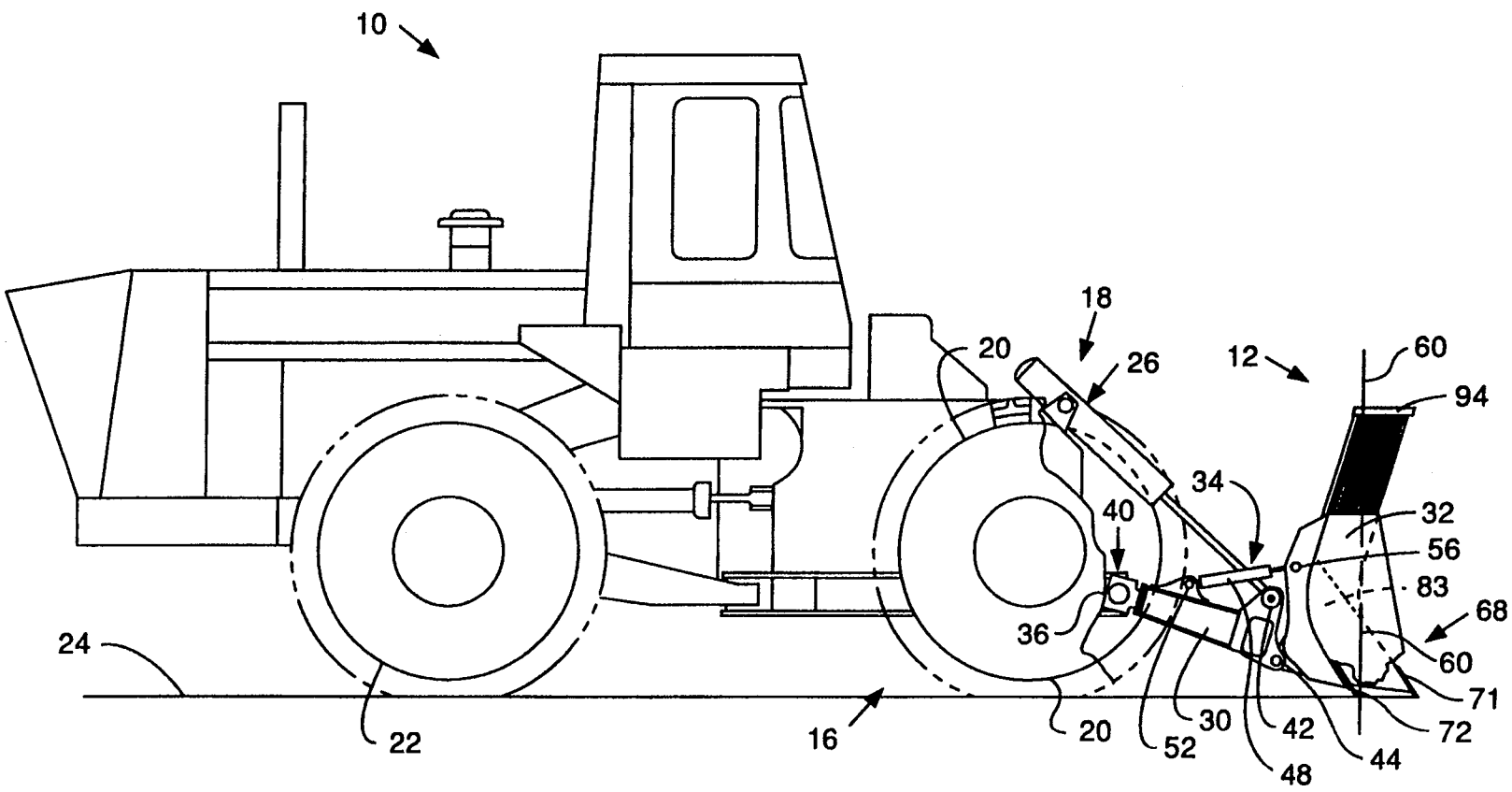
FIG. 2 is a diagrammatic representation of a side view of the vehicle and blade assembly of FIG. 1 with portions thereof broken away for clarity.
Figure 3:
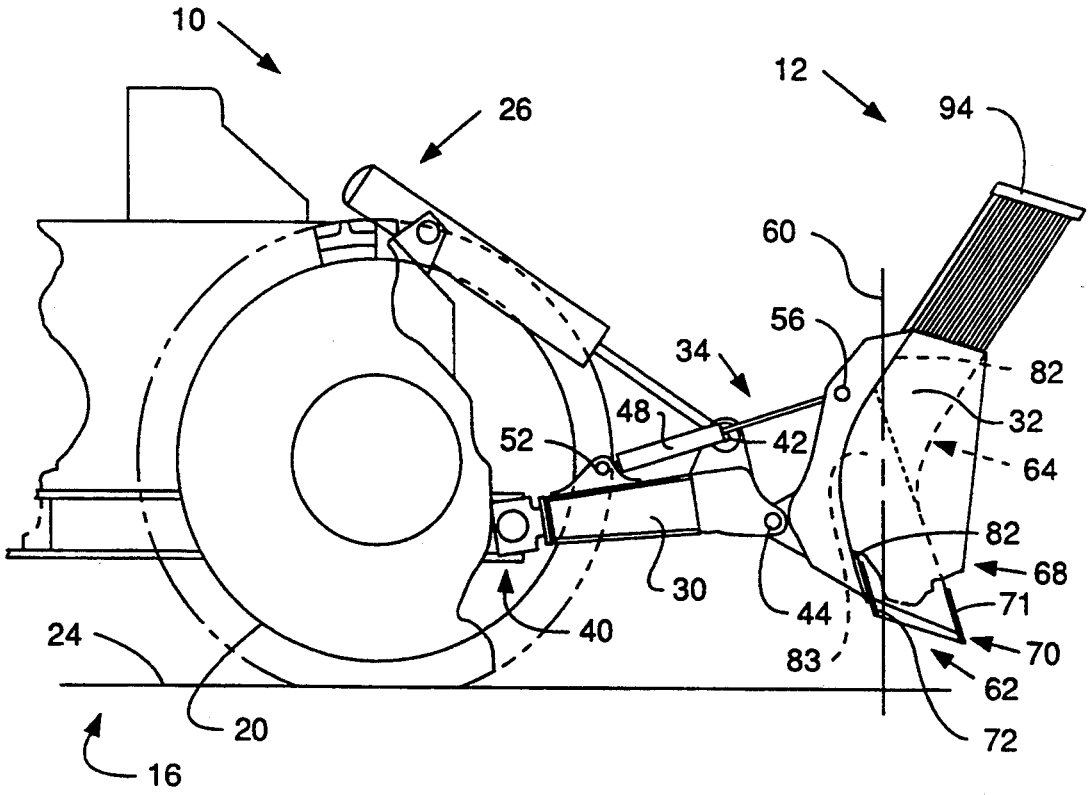
FIG. 3 is a partial view diagrammatically illustrating the blade assembly of FIG. 2 in a different operative position.

Referring to the drawings, and more particularly to FIGS. 1–3, a compacting vehicle 10 is illustrated having a blade assembly 12 mounted thereon. The compacting vehicle 10 is illustrated in a landfill environment having a volume of trash 14 which is spread by the blade assembly 12 and compacted by the compacting vehicle 10. The compacting vehicle 10 has respective compacting mechanisms 16,18 located on each side of the compacting vehicle in spaced apart relationship. In the compacting vehicle illustrated, the compacting mechanisms 16,18 are respective pairs of compacting wheels 20,22 located on each side of the compacting vehicle 10. Movement of the compacting vehicle 10 to spread and/or compact the trash 14 defines a travel path of the vehicle while contact of the compacting mechanisms 16,18 with the trash 14 being compacted defines a plane 24 that is parallel to the travel path of the compacting vehicle 10.

Even though the compacting vehicle 10 illustrated and described herein has respective compacting wheels 20,22 on each side thereof, it is recognized that the compacting vehicle could have continuous track on either side thereof without departing from the essence of the invention. It should be recognized that the term continuous track is not limited to metal track or other combinations thereof. The term would also include rubber and other known forms of belting. Furthermore, even though the compacting vehicle 10 illustrated herein is illustrated in the landfill environment having a volume of trash 14, it is further recognized that the subject invention could be utilized in other types of compacting vehicles, such as the spreading and compacting of soil, without departing from the essence of the invention.

A lift cylinder mechanism 26 is provided on the compacting vehicle 10 and is operatively connected to the compacting vehicle 10 and the blade assembly 12 to selectively raise and lower the blade assembly 12 in a conventional manner.

The blade assembly 12 includes a frame 30, a blade 32 pivotally connected to the frame 30, and means 34 for selectively pivoting the blade 32 relative to the frame 30.

Figure 4:
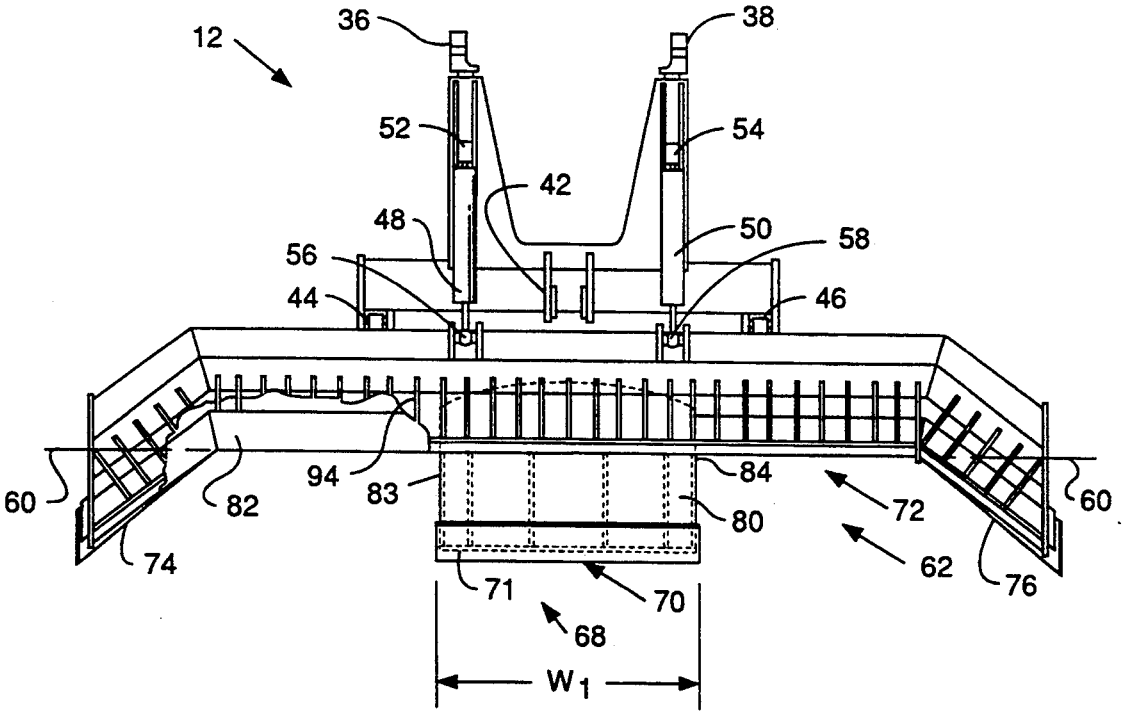
FIG. 4 is a diagrammatic representation of a top view of the blade assembly of FIG. 1.

Referring to FIG. 4 in conjunction with FIGS. 1–3, the frame 30 has first and second connection joints 36,38 which are adapted for pivotable connection to the compacting vehicle 10 at respective pivot joints 40 located on the compacting vehicle 10. A third connection joint 42 is located on the frame 30 and is adapted for pivotable connection with the lift cylinder mechanism 26 of the compacting vehicle 10. First and second pivot points 44,46 are located on the frame 30 and the blade 32 and are operative to permit the blade 32 to pivot relative to the frame 30.

The means 34 for pivoting the blade 32 relative to the frame 30 includes first and second cylinders 48,50 which are each connected to the frame at respective cylinder pivot points 52,54 and connected to the blade 32 at respective cylinder pivot points 56,58. It is recognized that other forms of means for pivoting the blade could be utilized without departing from the essence of the invention. For example, mechanical linkage could be use which would automatically pivot the blade in response to raising the blade.

The blade 32 defines a vertical plane 60 therein passing through a working edge 62 thereof and transverse to the travel path of the compacting vehicle 10. The working edge 62 is located on the blade 32 and is generally irregular in shape. The working edge 62 is operative to define the general contour of the surface of the trash 14 immediately behind the blade 32 during use of the compacting vehicle 10. The blade 32 likewise has a moldboard 64 immediately behind the working edge 62 to direct the flow of the trash 14 passing across the working edge 62.

The blade 32 has a means 68 protruding forwardly thereof and centrally located therealong for controlling the volume of trash 14 being directed under the blade 32 between the compacting mechanisms 16,18. The protruding means 68 of the blade 32 includes a first portion 70 of the working edge 62 and has a cutting edge 71. The first portion 70 of the working edge 62 extends forwardly of a remaining portion 72 of the working edge 62. As illustrated in FIG. 4, the vertical plane 60 and the remaining portion 72 of the working edge 62 lie in the same plane. The cutting edge 71 of the first portion 70 is parallel with the vertical plane 60.

The working edge 62 also has a forwardly and outwardly extending portion 74 on one end of the blade 32 and another forwardly and outwardly extending portion 76 on the other end thereof. Each of the respective forwardly and outwardly extending portions 74,76 of the working edge 62 extend forwardly and outwardly of the remaining portion 72 thereof. The first portion 70 of the working edge 62 has a predetermined width $W_1$ taken parallel to the vertical plane 60.

The moldboard 64 of the blade 32 has a first portion 80 which extends rearwardly and forwardly from the first portion 70 of the working edge 62 to blend with a remaining portion 82 of the moldboard at a location spaced from the remaining portion 72 of the working edge 62. First and second sidewalls 83,84 extend generally from the first portion 70 of the working edge 62 rearwardly and contiguous with the first portion 80 of the moldboard 64 to the remaining portion 82 of the moldboard 64.

The working edge 62 and the blade 32 is movable between a first position at which the working edge is aligned along the plane 24 parallel to the surface traversed by the compacting mechanisms 16,18 of the compacting vehicle 10 and a second position at which the first portion 70 and each of the forwardly and outwardly extending portions 74,76 of the working edge is at a level lower, relative to the plane 24 of the surface traversed by the compacting mechanisms 16,18, than the level of the remaining portion 72 thereof. The blade 32 is illustrated in its first position in FIG. 2 and is illustrated in its second position in FIG. 3. The working edge 62 is moved to its second position by using the lift cylinder mechanism 26 to raise the blade assembly 12 and using the pivoting means 34 to tip the blade 32 forwardly relative to the frame 30.

Figure 5:
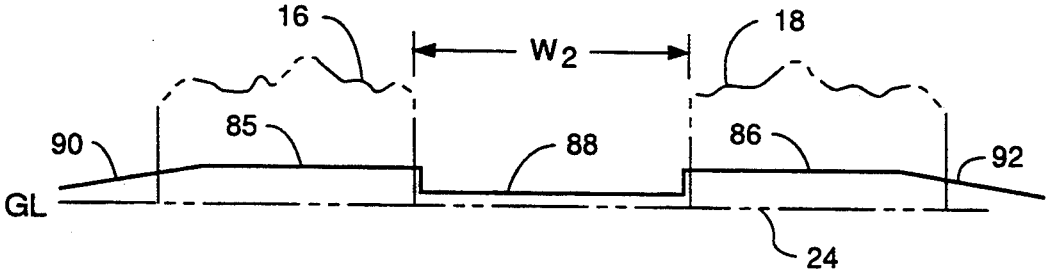
FIG. 5 is a graph diagrammatically illustrating the path left by the blade assembly when used in the operative position illustrated in FIG. 3.

Referring to FIG. 5, a graph is illustrated diagrammatically depicting the path of trash 14 immediately following the working edge 62 of the blade 32 during operation in its second position but prior to being subjected to the compacting mechanisms 16,18 of the compacting vehicle 10. The compacting mechanisms 16,18 are represented by phantom lines and are spaced apart at a width $W_2$. The width $W_2$ between the compacting mechanisms 16,18 is slightly wider than the width $W_1$ of the first portion 70 of the protruding means 68. However, it is recognized that the width $W_1$ of the first portion 70 of the cutting edge 62 could be generally the same as the width $W_2$ of the spacing between the compacting mechanisms 16,18.

As noted from a review of the graph illustrated in FIG. 5, the center portion under the compacting vehicle 10 between the compacting mechanisms 16,18 is being effectively cleared by the width $W_1$ of the first portion 70 of the working edge 62 while a larger volume of the trash 14 remains in the travel path of the respective compacting mechanisms 16,18. Likewise, the forwardly and outwardly extending portions 74,76 effectively clear the path of trash 14 on each side of the compacting vehicle 10. Horizontal lines 85,86 in the graph illustrated in FIG. 5 correspond with the remaining portion 70 of the cutting edge 62 while the horizontal line 88 of the graph is representative of the first portion 70 of the protruding means 68. Furthermore, the lines 90,92 extending from the respective horizontal lines 85,86 are representative of the forwardly and outwardly extending portions 74,76 located on each end of the blade 32.

A trash guard 94 is located on the top of the blade 12 and is operative, during use, to deflect the trash 14 forwardly thereof and also has openings therethrough to allow the operator better visibility of the trash being spread and/or compacted.

Figure 6:
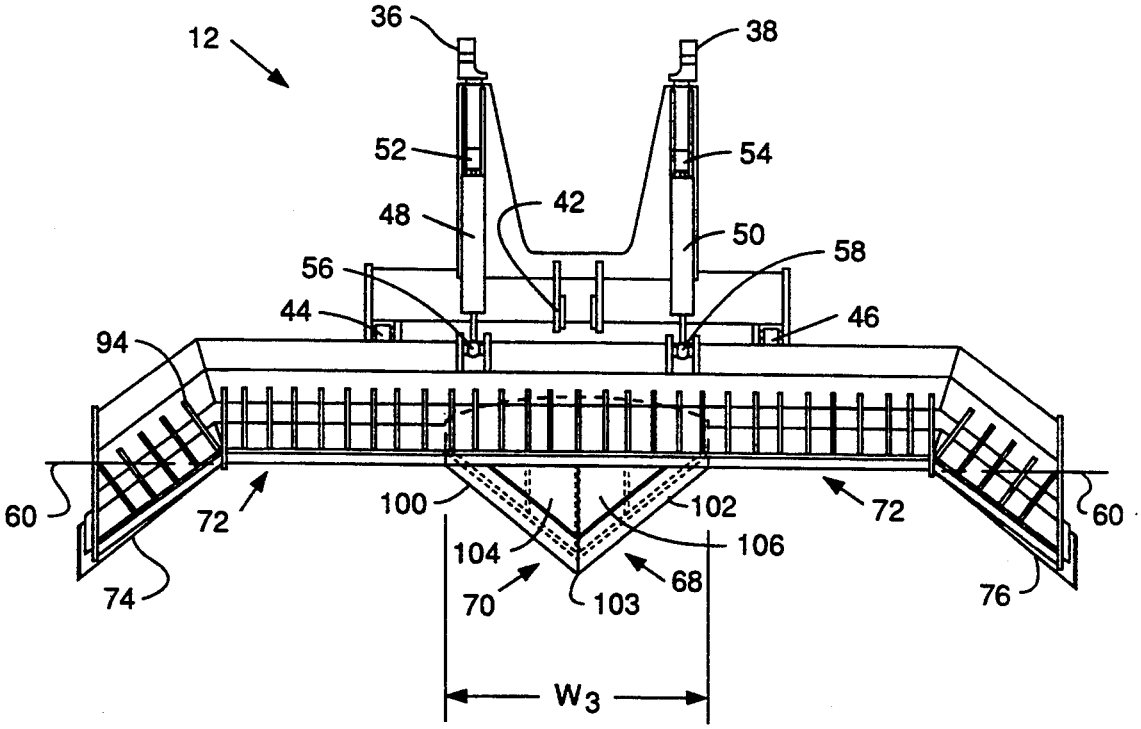
FIG. 6 is a diagrammatic representation of a top view of another embodiment of the present invention.
Figure 7:
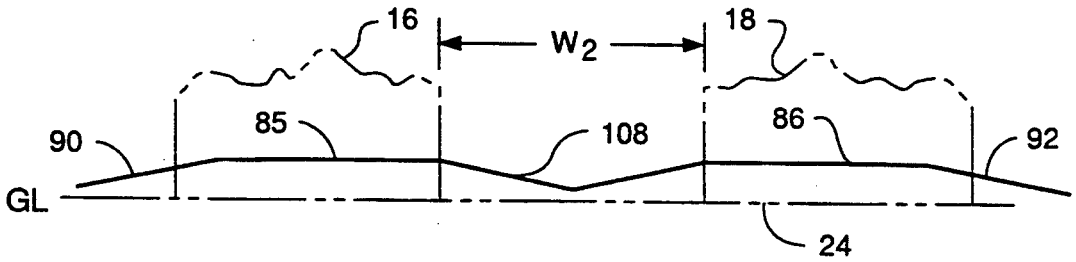
FIG. 7 is a graph diagrammatically illustrating the path left by the blade assembly of FIG. 6 when being operated in the operative position illustrated by FIG. 3.

Referring now to FIGS. 6 and 7 of the drawings, another embodiment of the blade assembly 12 is illustrated. In this embodiment, elements that are the same or similar to elements from the previous embodiment have the same element numbers. The protruding means 68 of the subject embodiment has the first portion 70 extending forwardly from the blade 32, however, in this embodiment the first portion 70 is generally vee or V-shaped with the closed portion of the vee shape being forward of the remaining portion 72 of the working edge 62. The generally vee shaped first portion 70 has first and second cutting edges 100,102 angled one with the other to form the vee shape. In the subject embodiment, the first and second cutting edges 100,102 extend from an apex 103 which is located forwardly of the blade 32 and extends rearwardly to blend with the remaining portion 72 of the working edge 62.

A first moldboard surface 104 extends from the first cutting edge 100 and a second moldboard surface 106 extends from the second cutting edge 102 and the respective first and second moldboard surfaces 104,106 intersect each other and blend with the remaining portion 82 of the moldboard 64.

The first portion 70 of the working edge 62 has an effective width $W_3$ taken parallel to the vertical plane 60 that is slightly wider than the width $W_1$ of the first portion 70 set forth in the embodiment of FIGS. 1–4. The effective width $W_3$ of the vee shaped first portion 70 is generally equal to the width $W_2$ of the spacing between the compacting mechanisms 16,18. It is recognized that the width $W_3$ of the first portion 70 could be slightly less than the width $W_2$ without departing from the essence of the invention.

With the blade 32 in its first position, the working edge 62 is aligned generally along the plane 24 that is parallel to the travel path of the compacting vehicle as previously illustrated in FIG. 2 with respect to the first embodiment.

The graph of FIG. 7 diagrammatically illustrates the path created by the working edge 62 of the blade 32 of the subject embodiment during use in its second position. The horizontal lines 85,86 correlate with the remaining portion 72 of the working edge 62 like the corresponding horizontal lines 85,86 illustrated in FIG. 5 of the previous embodiment. Likewise, the angled lines 90,92 correlate with the forwardly and outwardly extending portions 74,76 located on each end of the blade 32. The vee shaped line 108 of the graph illustrated in FIG. 7 correlates with the vee shaped first portion 70 of the subject embodiment.

Figure 8:
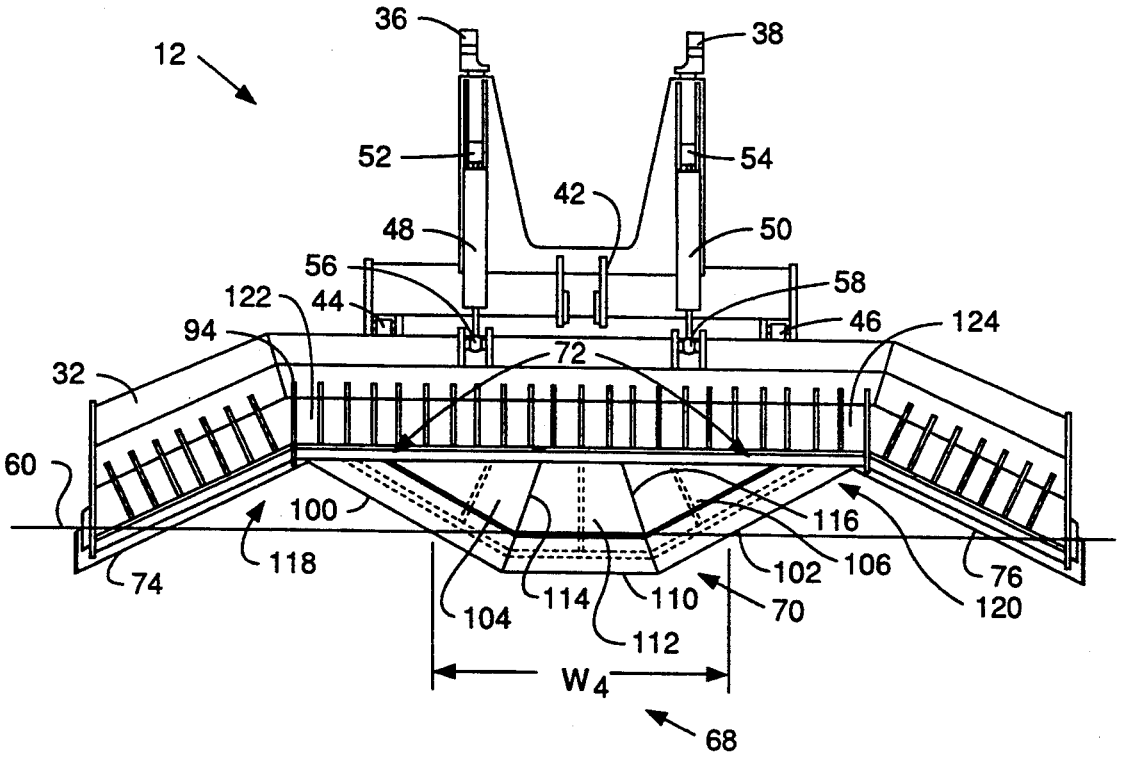
FIG. 8 is a diagrammatic representation of a top view of another embodiment of the present invention.
Figure 9:
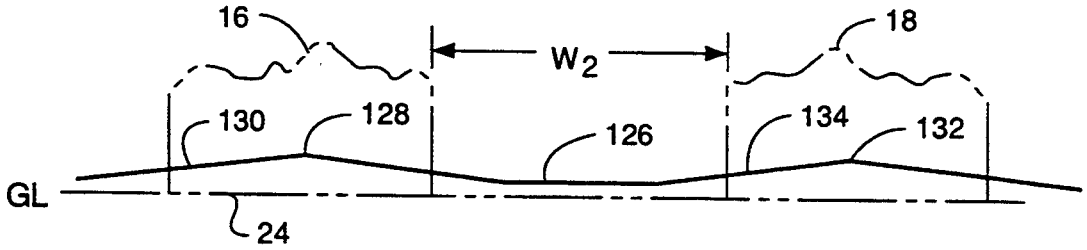
FIG. 9 is a graph diagrammatically representing the path left by the blade assembly of FIG. 8 when being operated in the operative position illustrated by FIG. 3.

Referring to FIGS. 8 and 9, another embodiment of the blade assembly 12 is illustrated. In this embodiment, elements the same or similar to elements of previous embodiments have the same element numbers. In the embodiment illustrated in FIG. 8, the plane 60 transverse to the travel path of the compacting vehicle 10 is defined therein. The forwardly and outwardly extending portions 74,76 are located on opposite ends of the blade 32 and are located forwardly of the vertical plane 60. The means 68 protruding forwardly of the blade 32 extends forwardly of the vertical plane 60 and has the first portion 70 of the working edge 62 centrally located along the vertical plane 60. The effective width $W_4$ of the first portion 70 taken parallel to the vertical plane 60 is generally equal to the width $W_2$ of the space between the compacting mechanisms 16,18. It is recognized, as previously noted, that the width $W_4$ of the first portion of the subject embodiment could be slightly less than the width $W_2$ between the compacting mechanisms 16,18. The first portion 70 has the first and second cutting edges 100,102 and the first and second moldboard surfaces 104,106 respectively extending therefrom. The first portion 70 of the subject embodiment also includes another portion, such as, a third cutting edge 110 that is oriented parallel to the vertical plane 60 and forward thereof. The third cutting edge 110 extends to intersect the first and second cutting edges 100,102. A third moldboard surface 112 extends from the third cutting edge 110 and has first and second edges 114,116 which are contiguous with the first and second moldboard surfaces 104,106 and extend rearwardly to blend with the remaining portion 82 of the moldboard 64.

The remaining portion 72 of the working edge 62 includes first and second rearwardly extending portions 118,120. The first and second rearwardly extending portions 118,120 extend rearwardly from the vertical plane 60. The first rearwardly extending portion 118 connects with the first cutting edge 100 of the first portion 70 and the forwardly and outwardly extending portion 74 on the one end of the blade 32 to form a first vee shape with an apex 122 thereof located rearwardly of the vertical plane 60. The second rearwardly extending portion 120 connects with the second cutting edge 102 of the first portion 70 and the forwardly and outwardly extending portion 76 on the other end of the blade 32 to form a second vee shape having an apex 124 located rearwardly of the vertical plane 60. The apex 122 of the first vee shape is located generally centrally along the path of the compacting mechanism 16 on one side of the compacting vehicle and the apex 124 of the second vee shape is located generally centrally along the path of the compacting mechanism 18 on the other side of the compacting vehicle 10.

FIG. 9 illustrates a graph diagrammatically depicting the path in the trash 14 created by the working edge of the blade 32 of the subject embodiment when it is in its second position. A horizontal line 126 in the graph correlates with the third cutting edge 110 of the first portion 70. An apex 128 of a first vee shaped line 130 correlates with the apex 122 of the first rearwardly extending portion 118 while an apex 132 of a second vee shaped line 134 correlates with the apex 124 of the second rearwardly extending portion 120.

The present invention provides a blade assembly 12 for a compacting vehicle 10 having a working edge 62 that during operation of the blade assembly 12 with the blade 32 in its first operative position is effective to spread trash and/or soil 14 level since the working edge 62 lies in the plane 24 parallel to the path being traversed by the compacting vehicle 10. Further, when the blade assembly 12 is raised and the blade 32 is pivoted to its second position, the remaining portion 72 of the working edge 62 is effective to permit a controlled volume of trash and/or soil 14 to pass thereunder for compaction by the respective compacting mechanisms 16,18 thereof. At the same time, the first portion 70 of the working edge 62 is effective to control the volume of trash and/or soil 14 passing thereunder between the compacting mechanisms 16,18 of the compacting vehicle 10. By controlling the volume of trash and/or soil 14 allowed to pass under the compacting vehicle 10 between the compacting mechanisms 16,18, the trash and/or soil 14 is prohibited from contacting or at least substantially eliminated from contacting the components on the under side of the compacting vehicle 10 between the compacting mechanisms 16,18.

Industrial Applicability

During use, the blade assembly 12 is used to spread and compact trash 14 in a landfill and to spread and compact soil on top of the compacted trash to avoid erosion of the trash 14. In order to spread soil over the compacted trash, it is beneficial for the working edge 62 to be oriented parallel with the plane 24 that is parallel to the travel path of the compacting vehicle 10. While spreading and compacting soil over the top of the trash 14, the blade 32 is maintained in its first position with respect to the frame 30 and slightly raised to allow an even volume of soil to pass under the working edge 62 which is then subsequently compacted by the compacting mechanisms 16,18. Since only a small volume of soil is allowed to pass under the working edge 62, there is no difficulties with the soil contacting and creating detrimental wear to the bottom of the compacting vehicle 10 between the compacting mechanisms 16,18.

When it is desirable to spread and compact trash 14, the blade 32 is raised above the plane 24 that is parallel to the travel path of the compacting vehicle and pivoted to its second position. When spreading and compacting trash, the remaining portion 72 of the working edge 62 is generally raised approximately 30–60 centimeters (12–24 inches) above the plane 24 thereof. The remaining portion 72 of the working edge 62 controls the height of the trash 14 being subjected to the compacting mechanisms 16,18. The first portion 70 of the working edge 62 is effective to reduce the volume of trash 14 allowed to pass under the working edge 62 between the compacting mechanisms 16,18. Likewise, the respective forwardly and outwardly extending portions 74,76 on each end of the blade 32 control the volume of trash 14 on either side of the compacting vehicle 10.

Each of the illustrated and described embodiments noted above are effective to perform the same function. The general relationship between the various embodiments are best understood by a review of the graphs illustrated in FIGS. 5, 7 and 9. In FIG. 5, the horizontal lines 85,86 are representative of the height of the trash 14 left by the remaining portion 72 of the working edge 62 for the respective compacting mechanisms 16,18 to compact. On the graph, the distance between the plane 24 of the vehicle travel path and the horizontal lines 85,86 is representative of the height that the remaining portion 72 of the working edge 62 is raised above the plane 24. The horizontal line 88 of the graph in FIG. 5 clearly indicates the path cleared by the first portion 70 of the working edge 62 to eliminate the trash 14 from contacting and causing wear to components under the compacting vehicle 10 between the compacting mechanisms 16,18. The angled lines 90,92 and the graph in FIG. 5 indicates the path cleared on either side of the compacting vehicle 10 by the respective forwardly and outwardly extending portions 74,76 to further eliminate the trash 14 from becoming clogged in and/or causing wear of the sides of the compacting mechanisms 16,18.

The graph diagrammatically illustrated in FIG. 7 shows the path of trash 14 left by working edge 62 of the blade 32 of another of the embodiments. The horizontal lines 85,86 of the graph of FIG. 7, in relationship to the plane 24, are the same as that set forth with respect to the path left by the blade 32 of the graph in FIG. 5. Likewise, the angled lines 90,92 are defined in the same manner as that with respect to the angle lines 90,92 of FIG. 5. The vee shape line 108 of the graph in FIG. 7 is different from the horizontal line 88 of the graph in FIG. 5 due to the fact, that the first portion 70 of the embodiment illustrated in FIG. 6 is generally a vee shape and once the blade 32 is raised and pivoted to its second position, the apex 103 of the vee shape is at a level lower than other portions thereof. Even though the shape of the path of the trash 14 left behind the working edge 62 of the blade 32 between the compacting mechanisms 16,18 of the embodiment of FIG. 6 is different, it is still very effective to control the volume of trash 14 passing under the compacting vehicle 10 between the compacting mechanisms 16,18.

The graph diagrammatically illustrated in FIG. 9 again is quite different in shape than the path left by the blade 32 of the previous embodiments. In the subject embodiment illustrated by the graph in FIG. 9, a generally vee shaped path of trash 14 is permitted to pass under the working edge 62 of the blade 22 for the respective compacting mechanisms 16,18 to compact. The respective apexes 128,132 of the respective vee shaped lines 130,134 illustrates the maximum height of the trash 14 permitted to pass under the working edge 62 for the respective compacting mechanisms 16,18 to compact. As clearly illustrated in the graph in FIG. 9, the volume of trash 14 permitted to pass under the first portion 70 of the working edge 62 is greatly reduced thus eliminating or at least substantially reducing any possibilities of the trash 14 contacting and causing wear to components under the compacting vehicle 10 between the respective compacting mechanisms 16,18.

In view of the foregoing, it is readily apparent that the structure of the present invention provides a blade assembly 12 which has a simple construction and allows both level spreading of soil and/or trash 14 while also providing the ability for the blade 32 to spread trash for the respective compacting mechanisms 16,18 to compact. Simultaneously, the blade 32 controls the volume of soil and/or trash 14 passing under the first portion 70 of the working edge 62 so that components under the compacting vehicle 10 between the compacting mechanisms 16,18 are not subjected to unnecessary wear and/or packing of materials therein.

Other aspects, objects, and advantages of this invention can be obtained from a study of the drawings, the disclosure, and the appended claims.

I claim:

1. A blade assembly adapted for use on a compacting vehicle having a compacting mechanism located on each side of the compacting vehicle in spaced apart relationship, the blade assembly comprising:

a frame adapted for pivotable connection with the compacting vehicle;

a blade pivotally connected to the frame and movable between a first operative position and a second operative position, the blade having a working edge with a vertical plane defined generally therethrough transverse to a travel path of the compacting vehicle, the working edge having a first portion centrally located along the blade and extended forwardly of the vertical plane and a remaining portion located at or behind the vertical plane having portions thereof located on opposite sides of the first portion, the working edge defines a plane in the first operative position that is substantially parallel with a surface traversed by the compacting mechanisms of the compacting vehicle and the blade being free of other working edges disposed below the substantially parallel plane; and means for pivoting the blade, when in use, relative to the frame between the first operative position and the second operative position at which the first portion of the working edge is at a level lower, relative to the surface traversed by the compacting mechanisms, than the level of the remaining portion of the working edge.

2. The blade assembly of claim 1 wherein an effective width of the first portion, taken parallel to the vertical plane, is generally equal to or slightly less than a width of the space between the compacting mechanisms of the compacting vehicle.

3. The blade assembly of claim 2 wherein the working edge has a forwardly and outwardly extending portion on one end of the blade and another forwardly and outwardly extending portion on the other end of the blade.

4. The blade assembly of claim 3 wherein the first portion of the working edge is generally parallel-with the vertical plane.

5. The blade assembly of claim 3 wherein the first portion of the working edge is generally vee shaped with the closed portion of the vee shape being forward of the vertical plane.

6. The blade assembly of claim 5 wherein the remaining portion of the working edge includes first and second rearwardly extending portions extending rearwardly of the vertical plane in spaced apart relationship and respective ones of the first and second rearwardly extending portions connect with the first portion and the respective forwardly and outwardly extending portions at the opposite ends of the blade to form first and second vee shapes each having an apex rearward of the vertical plane.

7. The blade assembly of claim 3 wherein the first portion of the working edge has a portion oriented parallel to the vertical plane and spaced forwardly thereof.

8. A landfill blade assembly of a type serving to control the volume of trash passing under a blade of the blade assembly in the path of a vehicle and into respective paths of compacting mechanisms disposed on opposite sides of the vehicle, the blade assembly comprising:

a working edge located on the blade and, when the blade is used in a first operating position, the working edge is aligned substantially along a plane parallel with a surface traversed by the compacting mechanisms disposed on opposite sides of the vehicle and the blade being free of other working edges disposed below the substantially parallel plane; and means on the blade protruding forwardly of the blade and centrally located therealong for controlling the volume of trash being directed under the blade between the compacting mechanisms when, during use in a second operative position, the blade assembly is raised and the blade is pivoted forwardly, so that a smaller volume of trash is permitted to pass under the blade between the compacting mechanisms as compared to the volume of trash permitted to pass under the blade in the path of the respective compacting mechanisms.

9. The landfill blade assembly of claim 8 including forwardly and outwardly extending portions formed on the ends of the blade and each being operative to retain the trash in the region of the paths of the respective compacting mechanisms.

10. The landfill blade assembly of claim 9 wherein the protruding means is generally vee shaped.

11. The landfill blade assembly of claim 9 wherein the working edge has a first portion and a remaining portion, the first portion of the working edge is part of the protruding means and is oriented transversely with the travel path of the vehicle.

12. The landfill blade assembly of claim 11 wherein the remaining portion of the working edge includes first and second rearwardly extending portions extending rearwardly of the vertical plane in spaced apart relationship and respective ones of the first and second rearwardly extending portions connect with the first portion and the respective forwardly and outwardly extending portions at the opposite ends of the blade to form first and second vee shapes each having an apex rearward of the vertical plane.

13. A blade assembly adapted for use on a compacting vehicle having a compacting mechanism located on each side of the compacting vehicle in spaced apart relationship and a lift cylinder mechanism for raising and lowering the blade assembly, the blade assembly comprising;

a frame having first and second connection joints adapted, when assembled, for pivotable connection with the compacting vehicle, and a third connection joint adapted for pivotable connection, when assembled, with the lift cylinder mechanism;

a blade pivotally connected to the frame and movable between a first operative position and a second operative position, the blade defining a vertical plane therein transverse to a travel path of the compacting vehicle and has a working edge that defines a plane in the first operative position that is substantially parallel with a surface traversed by the compacting mechanisms of the compacting vehicle, the working edge has a first portion thereof extending forwardly of the vertical plane and a remaining portion located at or behind the vertical plane and having portions thereof located on opposite sides of the first portion, and the blade being free of other working edges disposed below the substantially parallel plane; and means for pivoting the blade, when in use, relative to the frame between the first operative position and the second operative position at which the first portion is at a level, relative to the surface traversed by the compacting mechanisms of the compacting vehicle, lower than the level of the remaining portion so that upon raising the blade above the surface traversed by the compacting mechanisms of the compacting vehicle and pivoting the blade forwardly to the second operative position thereof the first portion of the working edge is closer to the surface being traversed by the compacting mechanisms of the compacting vehicle than the remaining portion of the working edge.

14. The blade assembly of claim 13 wherein the first portion of the working edge is generally centrally located along the front of the blade.

15. The blade assembly of claim 14 wherein the working edge has a forwardly and outwardly extending portion located on one end of the blade which extends forwardly and outwardly from the remaining portion and a forwardly and outwardly extending portion located on the other end of the blade which extends forwardly and outwardly from the remaining portion, when in use with the blade in its first operative position the working edges of the respective forwardly and outwardly extending portions are generally aligned along the plane parallel to the path traversed by the compacting mechanisms of the compacting vehicle and when the blade is raised and pivoted forwardly to the second operative position the respective forwardly and outwardly extending portions of the working edge are closer to the plane of the surface being traversed by the compacting mechanisms of the compacting vehicle than the remaining portion thereof.

16. The blade assembly of claim 14 wherein the first portion of the working edge is generally parallel with the remaining portion thereof and spaced forwardly therefrom.

17. The blade assembly of claim 16 wherein the blade has a moldboard extending from the working edge and the moldboard includes a first portion and a remaining portion, the remaining portion is at or behind the vertical plane, the first portion of the moldboard extends from the first portion of the working edge and blends with the remaining portion of the moldboard at a location spaced upwardly from the remaining portion of the working edge.

18. The blade assembly of claim 17 wherein the first portion of the moldboard extending from the first portion of the working edge has first and second sidewalls extending generally from the first portion of the working edge rearwardly and contiguous with the first portion of the moldboard to the remaining portion of the moldboard and each of the sidewalls being oriented perpendicular with the plane of the surface traversed by the compacting vehicle.

19. The blade assembly of claim 18 wherein the space between the compacting mechanisms has a width and the first portion of the working edge has a width that is generally equal to or slightly less than the width of the space between the compacting mechanisms.

20. The blade assembly of claim 14 wherein the blade has a moldboard extending from the working edge, the moldboard includes a first portion and a remaining portion, the first portion of the working edge has first and second cutting edges angled one with the other to form a vee shape, the first portion of the moldboard includes a first moldboard surface extending from the first cutting edge of the first portion of the working edge and a second moldboard surface extending from the second cutting edge thereof, the first and second moldboard surfaces extend rearwardly and upwardly to blend with the remaining portion of the moldboard extending from the remaining portion of the working edge.

21. The blade assembly of claim 20 wherein the working edge has a forwardly and outwardly extending portion located on one end of the blade which extends forwardly and outwardly from the remaining portion and a forwardly and outwardly extending portion located on the other end of the blade which extends forwardly and outwardly from the remaining portion, when in use with the blade in its first position the respective forwardly and outwardly extending portions of the working edge are generally aligned along the plane coincidental with the surface traversed by the compacting mechanisms of the compacting vehicle and when the blade is raised and pivoted to the second position during use, the respective forwardly and outwardly extending portions thereof are closer to the plane of the surface being traversed by the compacting mechanisms of the compacting vehicle than the remaining portion thereof.

22. The blade assembly of claim 21 wherein the space between the compacting mechanisms has a width and the first portion of the working edge has an effective width taken parallel to the vertical plane of the blade that is generally equal to or slightly less than the width of the space between the compacting mechanisms of the compacting vehicle.

23. The blade assembly of claim 20 wherein the first portion of the working edge has a third cutting edge which is generally centrally located between the first and second cutting edges and intersects the ends thereof.

24. The blade assembly of claim 23 wherein a third moldboard surface having first and second edges extends rearwardly from the third cutting edge and blends with the remaining moldboard portion at a location spaced from the remaining portion of the working edge.

25. The blade assembly of claim 24 wherein the first and second edges of the third moldboard surface blend with respective ones of the first and second moldboard surfaces extending from the first and second cutting edges of the first portion of the working edge.

26. The blade assembly of claim 25 wherein the working edge has a forwardly and outwardly extending portion located on one end of the blade which extends forwardly and outwardly from the remaining portion and a forwardly and outwardly extending portion located on the other end of the blade which extends forwardly and outwardly from the remaining portion, when in use with the blade in its first position the respective forwardly and outwardly extending portions of the working edge are generally aligned along the plane coincidental with the surface traversed by the compacting mechanisms of the compacting vehicle and when the blade is raised and pivoted to the second position the respective forwardly and outwardly extending portions thereof are closer to the plane of the surface being traversed by the compacting mechanisms of the compacting vehicle than the remaining portion thereof.

27. The blade assembly of claim 26 wherein the remaining portion of the working edge includes first and second rearwardly extending portions spaced from each other along and behind the vertical plane thereof, the first cutting edge of the first portion of the working edge and the forwardly and outwardly extending portion of the working edge on the one end of the blade intersect the first rearwardly extending portion to form a first vee shape and the second cutting edge of the first portion of the working edge and the forwardly and outwardly extending portion of the working edge on the other end of the blade intersect the second rearwardly extending portion to form a second vee shape.

28. The blade assembly of claim 27 wherein, when assembled and in use, the first vee shape has an apex which lies generally in alignment with a travel path of the midpoint of the compacting mechanism on one side of the compacting vehicle and the second vee shape has an apex which lies generally in alignment with a travel path of the midpoint of the compacting mechanism on the other side of the compacting vehicle.

* * * * *

UNITED STATES PATENT AND TRADEMARK OFFICE

CERTIFICATE OF CORRECTION

PATENT NO. : 5,392,864
DATED : February 28, 1995
INVENTOR(S) : Karl E. Lindenmuth It is certified that error appears in the above-indentified patent and that said Letters Patent is hereby corrected as shown below:

Column 11, claim 11 should read as follows:

The landfill blade assembly of claim 9 wherein the working edge has a vertical plane defined generally therethrough transverse to a travel path of the compacting vehicle, a first portion and a remaining portion , the remaining portion is at or behind the vertical plane, the first portion of the working edge is part of the protruding means and is oriented transversely with the travel path of the vehicle.

Signed and Sealed this

Twenty-second Day of August, 1995

*Attest:*

Bruce Lehman

BRUCE LEHMAN

*Attesting Officer*

*Commissioner of Patents and Trademarks*